US007487620B2

(12) United States Patent
West

(10) Patent No.: US 7,487,620 B2
(45) Date of Patent: Feb. 10, 2009

(54) WIND DIRECTIONAL SKYLIGHT VENT

(76) Inventor: Shane West, 5 Holder Street, Turner, Canberra ACT 2612 (AU)

( * ) Notice: Subject to any disclaimer, the term of this patent is extended or adjusted under 35 U.S.C. 154(b) by 588 days.

(21) Appl. No.: 10/498,101

(22) PCT Filed: Dec. 13, 2002

(86) PCT No.: PCT/AU02/01678

§ 371 (c)(1),
(2), (4) Date: Jun. 8, 2004

(87) PCT Pub. No.: WO03/052215

PCT Pub. Date: Jun. 26, 2003

(65) Prior Publication Data

US 2005/0005541 A1 Jan. 13, 2005

(30) Foreign Application Priority Data

Dec. 14, 2001 (AU) ..... PR9549

(51) Int. Cl.

| | |
|---|---|
| ***E04B 1/346*** | (2006.01) |
| ***E04B 7/00*** | (2006.01) |
| ***E04B 7/18*** | (2006.01) |
| ***F23L 17/04*** | (2006.01) |
| ***E04D 13/03*** | (2006.01) |

(52) U.S. Cl. ..... 52/200; 52/72; 52/198; 454/199; 454/9

(58) Field of Classification Search ..... 52/72, 52/200, 302.1, 198, 199; 454/9, 87, 17, 27, 454/199; 359/591, 597, 598
See application file for complete search history.

(56) References Cited

U.S. PATENT DOCUMENTS

| | | | | | |
|---|---|---|---|---|---|
| 209,506 | A | * | 10/1878 | Owens | 454/9 |
| 230,952 | A | * | 8/1880 | Mark | 454/199 |
| 299,387 | A | * | 5/1884 | Hayes | 454/199 |
| 906,440 | A | * | 12/1908 | Lewis | 454/17 |
| 913,556 | A | * | 2/1909 | Pehl | 454/199 |
| 1,299,286 | A | * | 4/1919 | Bartholomew | 454/17 |
| 1,507,462 | A | * | 9/1924 | Childers et al. | 454/17 |
| 2,711,126 | A | * | 6/1955 | Atkinson | 454/82 |
| 3,311,043 | A | * | 3/1967 | Atkinson | 454/275 |
| 4,197,682 | A | * | 4/1980 | Schiff et al. | 52/72 |
| 4,986,039 | A | * | 1/1991 | Weisner | 52/72 |
| 5,099,622 | A | * | 3/1992 | Sutton | 52/200 |
| 5,493,824 | A | * | 2/1996 | Webster et al. | 52/200 |

(Continued)

FOREIGN PATENT DOCUMENTS

AU 11330/99 B2 8/1999

(Continued)

*Primary Examiner*—Richard E Chilcot, Jr.
*Assistant Examiner*—Ryan D Kwiecinski
(74) *Attorney, Agent, or Firm*—TraskBritt

(57) ABSTRACT

A wind directional vent and skylight combination including: (a) a throat which may be in the form of a hood (60) rotatably mounted to a structure such as a building and in communication with a cavity to be exhausted such as a room of the building; (b) wind directional means associated with the hood (60), the wind directional means optionally being inherent in the shape and configuration of the hood (60), the wind directional means causing the hood (60) to rotate in response to changes in wind direction, wherein the hood (60) is made from material adapted to permit the passage of light therethrough.

20 Claims, 9 Drawing Sheets

U.S. PATENT DOCUMENTS

| | | | | | |
|---|---|---|---|---|---|
| 5,596,848 | A * | 1/1997 | Lynch | 52/200 | |
| RE36,496 | E * | 1/2000 | Sutton | 52/200 | |
| 6,302,778 | B1 | 10/2001 | Andrews et al. | | |
| 7,127,855 | B1 * | 10/2006 | Garvey | 52/198 | |

FOREIGN PATENT DOCUMENTS

| | | | |
|---|---|---|---|
| DE | 25 43 979 | A1 | 4/1977 |
| WO | WO 94/21871 | A1 | 9/1994 |

* cited by examiner

WIND DIRECTIONAL SKYLIGHT VENT

CROSS REFERENCES TO RELATED APPLICATIONS

This application is entered into the national phase filed on 08 Jun. 2004 under 35 U.S.C. §371 based on PCT/AU 02/01678 which designated the United States.

FIELD OF INVENTION

This invention relates to a vent. More particularly, this invention relates to a wind directional vent and skylight combination.

BACKGROUND ART

Wind directional vents have been described in which the vent comprises a throat rotatably mounted to a structure, such as the roof of a building, and a wind vane generally fixed to the top of the rotatable throat and oriented in a vertical plane. The vent aligns itself with the direction of the wind so that an exhaust mouth of the throat feeds into a pocket of air on the leeward side immediately adjacent the mouth having a negative pressure relative to the space from which the exhausted air comes.

Skylights have been described including a transparent or translucent cover material substantially flush or slightly raised above the roof line of a building and a shaft may be fitted having internally reflective lining material to permit the passage of light from the outside through to an internal living area.

The field of ventilation and light quality in working and living spaces is the subject of much research and development and improvements on the prior art are highly desirable and sought after.

The above description of the prior art is not intended to be, nor should it be interpreted as, an indication of the common general knowledge pertaining to the invention, but rather to assist the person skilled in the art in understanding the developmental process which led to the invention.

DISCLOSURE OF INVENTION

Accordingly, in one aspect the invention provides a wind directional vent and skylight combination including:

a) a throat rotatably mounted to a structure and in communication with a cavity to be exhausted;

b) wind directional means associated with the throat to cause the throat to rotate in response to changes in wind direction, wherein the throat is made from material adapted to permit the passage of light therethrough.

The throat may be made from material which is translucent and/or transparent. The throat may be made from a variety of materials having a wide range of optical properties. The throat may be made from a combination of materials or component parts. The throat may comprise a combination of an opaque or translucent portion and a translucent or transparent portion. For example, the portion associated with the mouth of the throat may be made of a material which is translucent or transparent and the back of the throat may be made from a translucent or opaque material. Preferably, however, the throat is integrally formed from a single translucent or transparent material.

The throat may be formed in a number of ways according to conventional methods of which the person skilled in the art will be familiar. Where the throat includes metal material such as light gauge aluminum or galvanised iron, the material may be cast or formed from sheets and worked into shape according to standard practice in the venting industry. The translucent or transparent material may be formed from a number of moulding processes. For example, the translucent or transparent material may be blow moulded. The different components of the throat may be joined together by any suitable means. For example, the throat components may be joined by rivets, industrial strength adhesive or other fastening methods familiar to skilled persons.

Preferably, however, the throat is formed from a single translucent and/or transparent material. The translucent and/or transparent material may be formed from a moulding process.

The wind directional means may be a feature attached to the throat. Alternatively, the wind directional means may be a feature inherent in the shape and configuration of the throat effective to cause the throat to rotate in response to changes in wind direction. For example, the external surface of the throat may be contoured whereby to provide wind directional means in which greatest wind resistance is effected when the mouth is facing windward and causes least wind resistance when the mouth is facing leeward. For example, the mouth of the throat may present a larger cross-sectional area than the external surface corresponding to the back of the throat, whereby the throat may tend to rotate until the orientation of least wind resistance is found so that the mouth faces leeward.

The wind directional means may include a wind vane in the form of a discreet feature mounted to the throat. The wind vane may include a panel or combination of panels. The vane may also be made from material which is translucent or transparent to permit the passage of light therethrough. In practice, the person skilled in the art will appreciate that in daylight hours the ambient light, particularly directly from the sun, will pass through the throat and/or the vane and into the cavity, thereby providing the internal areas of the structure with natural light.

Where the structure is a building having a roof cavity, for example defined by a roof truss, or other attic space, the inventive arrangement may be further provided with a hollow shaft communicating the base of the throat with the cavity to permit the egress of exhausted air from the cavity through the shaft and out through the mouth of the throat to the external environment. The hollow shaft may include an internal light reflective surface to maximise the passage of natural light from the external environment through to the cavity. Preferably the shaft is fixed relative to the structure and the throat may be rotatably mounted directly on the upper most portion of the shaft. The shaft may include vents in its wall or walls to exhaust the space in the roof cavity The rotatable throat may be mounted by a number of mounting means. For example, the throat may be mounted using an annular bearing. The annular bearing may include a teflon bush rotatably supporting the throat. Alternatively, the annular bearing may include a thrust bearing rotatably supporting the throat. In a separate embodiment, the throat may be mounted using a fixed shaft about which the throat rotates. The lower portion of the throat may be mounted to the shaft for rotation using a spider arrangement of which persons skilled in the art will be familiar.

The throat mounting means may include a bayonet arrangement. The bayonet may be attached or form part of either the base secured to the structure or to the throat, either directly or indirectly via, for example, a spider. A fixed shaft may be provided to form a bayonet stub receivable in a hollow body defining recess to which the spider is mounted for rotation. The throat may in turn be mounted to the spider. The recess may include releasable engagement means. The engagement means may include an interference screw or bolt, a rotatable cam adapted to frictionally bear on the bayonet or positive engagement means, such as a screw or nut and bolt in aperture arrangement. The recess may be adapted to snap on to the stub by deformation of resilient deflectable retainers.

To optimise the amount of natural light passed through the vent into the cavity, the throat may include a reflector. The reflector may be mounted in a location and orientation calculated to optimise the transmission of natural light into the cavity. For example, the reflector may be fixably mounted to the fixed shaft. The reflector may be spaced from the fixed shaft. The reflector may be located in a position facing a desired direction, based on performance required. For example, the reflector may be located to face in an easterly direction to capture the morning sun or a direction from which sunlight predominantly comes. For example, in the southern hemisphere, the reflector may face a generally northerly direction. In the northern hemisphere, the reflector may face a generally southerly direction whereby to optimise the amount of natural light reflected into the cavity. It will be appreciated that the reflector will remain in the same position irrespective of the rotated orientation of the throat. The reflector may be inclined to the vertical. The reflector may include a convex or concave surface to facilitate the transmission of natural light from a range of angles down the throat and into the cavity.

To optimise the low pressure of the pocket of air immediately adjacent to the mouth of the throat, the arrangement may include a drag inducer. The drag inducer may create turbulence immediately above the throat mouth to promote the exhaustion of air from the cavity into the throat and out to the immediate environment. The drag inducer may include an angled plate or a more solid feature with an inclined or curved surface. The drag inducer may be inclined away from the direction of the approaching wind. The drag inducer may be winged shaped to optimise the drag effect.

The drag inducer may be in the form of a cowl. The cowl may be a discreet feature attached to the throat such as a plate, panel, fin or the like. Alternatively, the cowl may be a feature inherent in the shape and/or configuration of the throat or a hood associated therewith. For example, the cowl may be formed integrally with the throat or hood. The cowl may be an inclined hood formed together with the throat during a moulding process, preferably a blow moulding process.

The throat may be in the form of a housing made of a variety of shapes or configurations. For example, the throat may be predominantly cylindrical. The mouth preferably faces the leeward direction, to reduce rain penetration and increase flow over exhaust suction. The throat may define a mouth with a range of different shapes. For example, the mouth may be circular, square, triangular or the like. The mouth may lie in a particular plane. The plane may be inclined to the vertical. The mouth may be inclined to the leeward or windward direction. The plane in which the mouth lies may be vertical and normal relative to the plane in which the vane generally lies. The mouth may be in the form of an extended portal, extending in the leeward direction.

The throat may include screening means to resist the ingress of pests, rain, dust, debris and the like. The screening means preferably is at least adapted to resist the entry into the cavity of nuisances such as birds, and mice and other vermin. Still more preferably, the screening means is adapted to resist the entry into the cavity of pests such as cockroaches, ants, bees, wasps and the like. The screening means may comprise a series of bars, slats, strips, parallel wires etc. adapted to resist entry by larger nuisances such as birds and pests such as mice. The screening means may include thin clear plastic slats or wire strands. The screening means may include fly mesh, such as plastic or metal mesh adapted to resist entry of smaller pests such as cockroaches, ants and other insects. However, it will be appreciated that use of insect screens may interfere with the draft achieved by the vent and may not be suitable in applications where only low draft is anticipated or high draft conditions are expected or necessary. The slats may be metal, plastic or wooden. The slats may be movable. The slats may be rotatable. The slats may be pivotable, either discreetly or in unison. Preferably, the slats are collectively pivotable about parallel axes in a single plane. The movement of the slats may be remotely controllable, such as by direct wire link or radio control to a servo-motor. For example, in high wind conditions where it is desirable to close the vent, it is a preferment that the screening means be adapted to substantially or effectively seal the throat when desirable. The screening means may be associated with the mouth of the throat and may extend across the mouth.

The screening means may comprise one or more flaps. Preferably, the one or more flaps is responsive to the draft flowing through the throat. The one or more flaps may be hinged to one side of the throat. The one or more flaps may be hinged whereby to pivot. Preferably, the screening means comprises a single flap adapted to rotate about an axis extending through a line intermediate the length of the flap. Preferably, the flap axis is off-centre, whereby the flap is adapted to return to a resting position under the action of gravity. Preferably, the resting position is a closed position. In a particularly preferred embodiment, the screening means is adapted to close the throat when a positive pressure is encountered immediately external to the mouth. Preferably the flap is adapted to open the throat when a negative pressure is encountered immediately outside the mouth whereby to permit draft flow through the throat to exhaust the cavity.

The throat may be formed from planar panels angled relative to one another to form the various components. For example, the throat may be rectangular or square box shaped. However, for optimum performance, it is preferred that the throat be cylindrical with its longitudinal axis aligned vertically. The roof of the throat is preferably curved to reduce turbulence within the throat and permit smooth egress of air therefrom. The diameter or lateral width of the throat may be varied. Generally, the larger the diameter or width, the greater the volume per unit time may be exhausted through the vent. In a preferred embodiment, the throat is cylindrical and the diameter thereof is 30 cm.

BRIEF DESCRIPTION OF THE DRAWINGS

The invention may be better understood from the following non-limiting description of the preferred embodiments, in which.

DETAILED DESCRIPTION OF THE DRAWINGS

Figure 1:
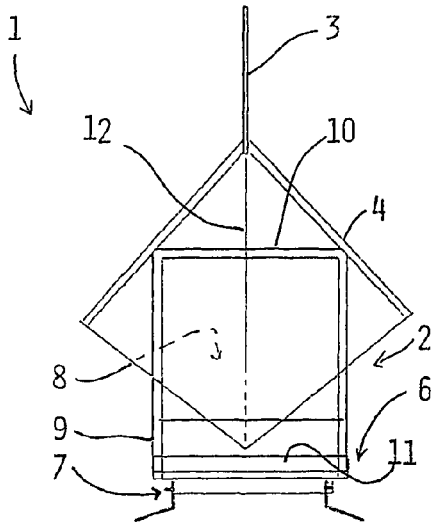
FIG. 1 is a rear elevation view of a vent according to a first embodiment.

In FIG. 1 there is shown a wind directional vent 1 including a box shaped throat 2, a vertical planar vane 3, an inclined cowl 4 and a neck 6 for rotatably mounting the throat 2 onto a structure, such as a roof line.

The throat 2 includes a mouth 8 through which air is ultimately exhausted into the immediate external environment. The mouth 8 is defined by a pair of vertical planar walls 9, an inclined roof line 10 terminating in a horizontal edge which meets the corresponding edges of the walls 9 and a lower edge 11 forming part of the neck 6. The neck 6 includes a ring bearing 7 mounting the throat 2 to the structure. The ring bearing 7 can be either a thrust bearing or may be bush mounted.

Figure 2:
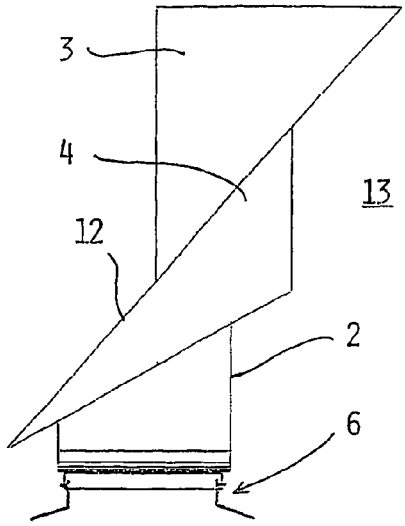
FIG. 2 is a side elevation of the vent of the first embodiment.

As best seen in FIG. 2, inclined cowl 4 is in the form of a hood comprising a pair of angled triangular sheets joined at a seam 12 corresponding to a ridge line extending the full length of the inclined cowl 4. As wind encounters the inclined cowl 4 it is deflected along the line of the pair of panels from which the cowl 4 is formed and travels over the pocket of air in the region marked by reference numeral 13 in which pocket of air there is produced a negative pressure. As it will be appreciated, the presence of the pocket 13 will induce a greater rate of exhaust flow from the throat 2 into the space 13 due to the increased turbulence.

The vent 1 of the first embodiment is predominantly made of flat perspex translucent or transparent panels which permit the transmission of light through the vane 3, inclined cowl 4 and throat 2 into the space below the neck 6. The panels predominantly making up the vane 3, cowl 4 and throat 2 may alternatively be made from clear or fogged glass. Preferably, the glass is shatter proof or otherwise reinforced for strength and durability.

Figure 3:
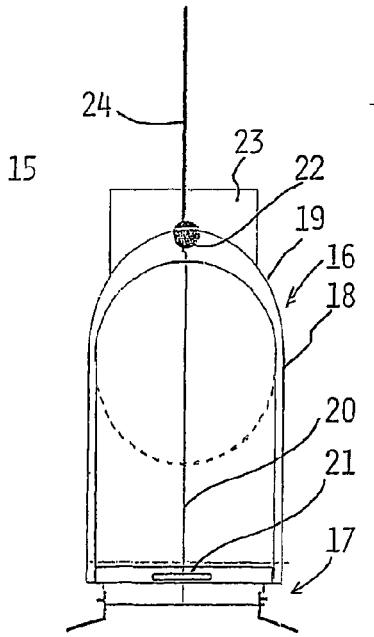
FIG. 3 is front elevation of a vent according to a second embodiment.

In FIG. 3 there is shown a vent with a predominantly cylindrical throat body 16. The throat comprises a substantially cylindrical body extending from its base 17 to its upper regions where its wall 18 meets a curved roof line 19 configured to minimise turbulence within the throat 16. The throat 16 is rotatably mounted via a spider (see FIG. 18) to a fixed shaft 20 using a rotating bearing 21. As is standard in the art, the rotating throat 16 may be secured at the top of the shaft 20 by a bush or second bearing 22.

Mounted on top of the roof 19 of the throat 16 is a drag inducer 23. The drag inducer 23 comprises a pair of flanges extending laterally either side of a vane 24 immediately above the mouth 25 of the throat 16. The vane 24 is located substantially leeward of the axis of the shaft 20 causing the throat 16 to rotate in response to changes in wind direction. It will be appreciated that as wind blows from a direction indicated by the letter W in FIG. 4, the turbulence of drag inducer 23 will cause an air pocket of negative pressure in the area identified by reference numeral 26. Again, the vane 24, inducer 23 and throat 16 may be made from glass or perspex whereby to permit the transmission of light from outside through the base of throat 16 into a cavity below a roof line 27.

Figure 4:
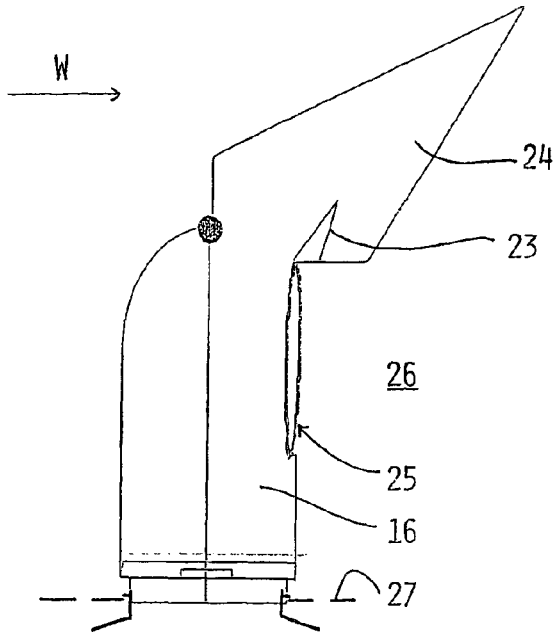
FIG. 4 is a side elevation of the vent according to the second embodiment.
Figure 5:
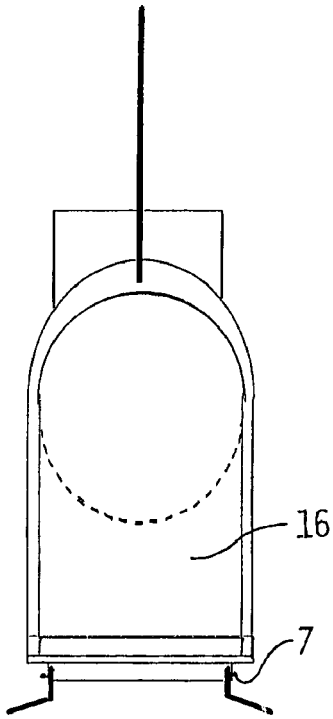
FIG. 5 is a front elevation of a vent according to a third embodiment.
Figure 6:
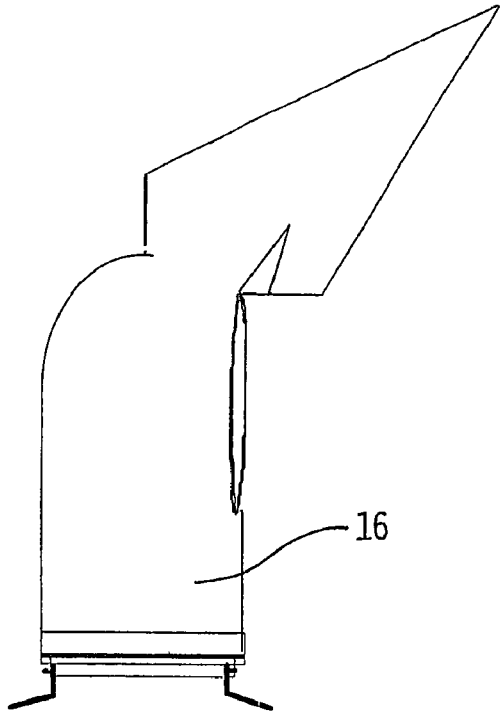
FIG. 6 is a side elevation of the vent according to the third embodiment.

The third embodiment shown in FIGS. 5 and 6 is similar to the second embodiment shown in FIGS. 3 and 4, but the means of mounting the throat 16 is by means of a ring bearing 7 similar to that described in relation to the first embodiment shown in FIGS. 1 and 2.

Figure 7:
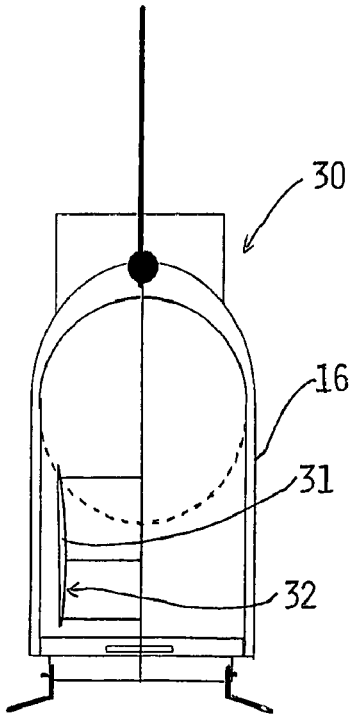
FIG. 7 is a front elevation of a vent according to a fourth embodiment.
Figure 8:
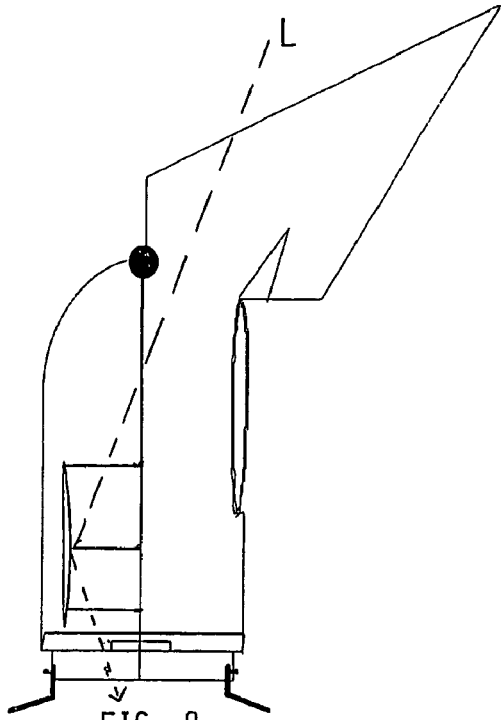
FIG. 8 is a side elevation of the vent according to the fourth embodiment.

In FIGS. 7 and 8 there is shown a fourth embodiment in the form of a vent 30 similar to the second embodiment described with reference to FIGS. 3 and 4, with the exception that a reflector 31 is provided within the throat 16. The reflector 31 may have a planar, convex or concave surface 32 adapted to generally face the direction from which the natural sunlight predominantly comes whereby to maximise the amount of natural light reflected into the cavity below the vent 30 as indicated by the dotted line marked "L". A planar reflector may be suitable where simple reflection of natural light is desired. The planar reflector may be inclined to the vertical. The convex reflector will be suitable for applications where diffuse natural light reflection is required. The concave reflector may be used to concentrate reflected light into the cavity. The concave and convex reflectors may be inclined to the vertical. The reflector 31 may be a mirror or may merely be made from a specular reflective material such as polished metal or foil.

Figure 9:
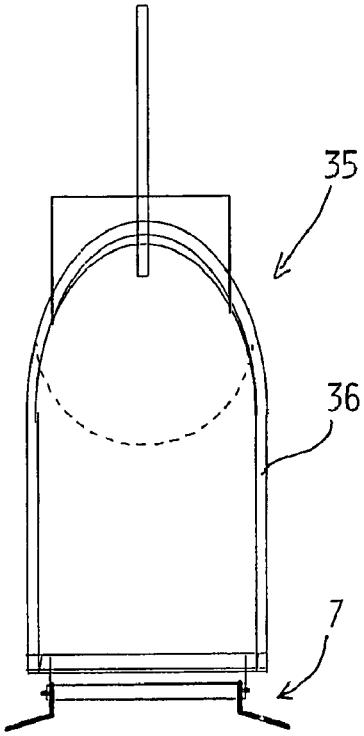
FIG. 9 is a front view of a vent according to a fifth embodiment.

In FIG. 9 there is shown a fifth embodiment in the form of a vent 35 mounted on a ring bearing 7. To minimise possible rain penetration and turbulence within a throat 36, the throat includes an exhaust port 37 extending substantially normal to the longitudinal axis of the lower portion 38 of the throat 36. The port 37 serves to better direct the exhaust flow through the throat 36 and promotes a greater exhaust volume per unit time than the mouth 25 shown in the vent 15 of the second embodiment. The vent 35 includes a simple vane construction 39 in the form of a planar triangular sheet extending substantially along the full length of the roof of the portal 37. On the top edge of the portal 37 is mounted a drag inducer 40 lying in a substantially vertical plane and being in the form of a pair of lateral panels extending either side of the vane 39.

Figure 10:
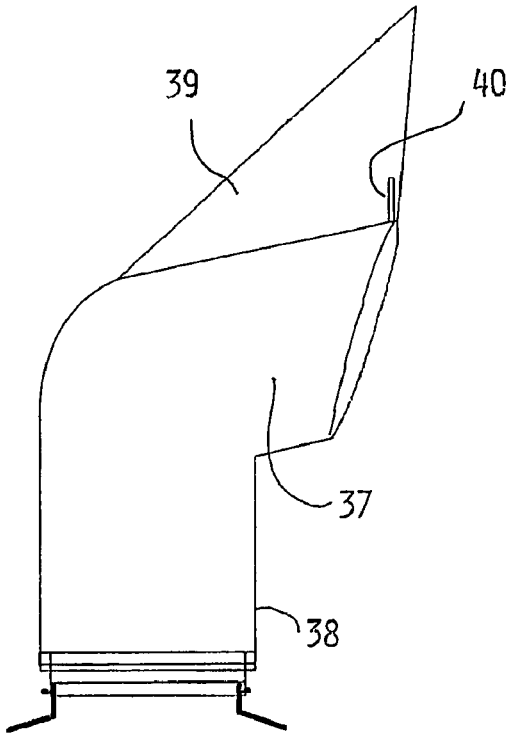
FIG. 10 is a side elevation of the vent according to the fifth embodiment.
Figure 11:
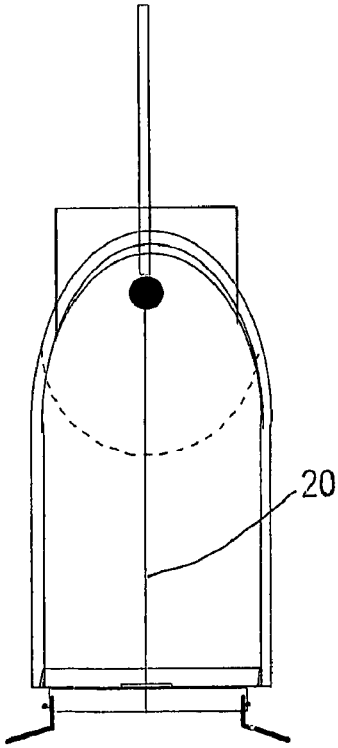
FIG. 11 is a front view of a vent according to a sixth embodiment.
Figure 12:
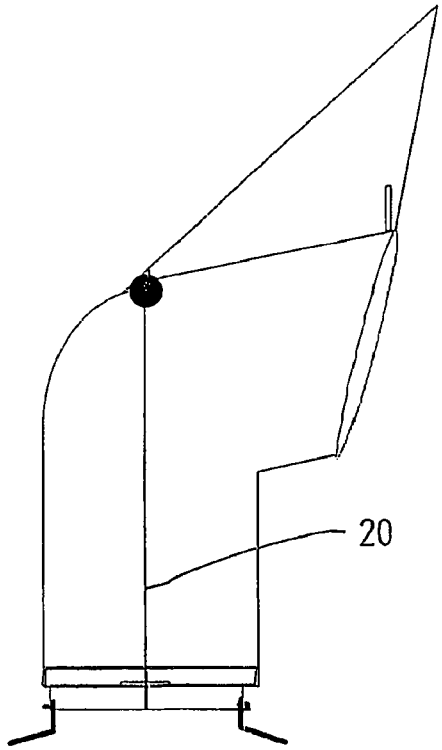
FIG. 12 is a side elevation of the vent according to the sixth embodiment.

The sixth embodiment shown in FIGS. 11 and 12 is substantially the same as that described with reference to FIGS. 9 and 10 with the exception that the throat 36 is mounted to a fixed shaft 20 similar to that described with reference to FIGS. 3 and 4.

Figure 13:
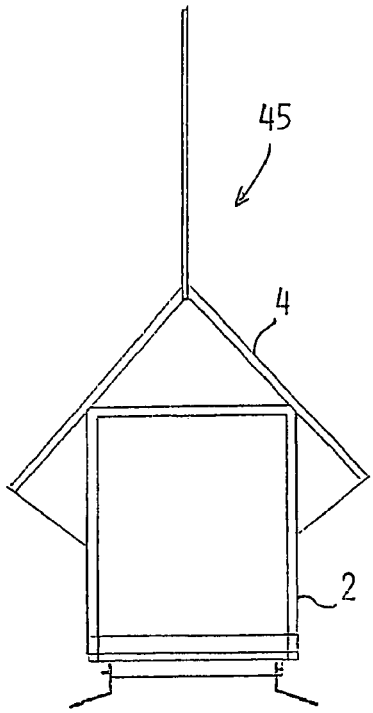
FIG. 13 is a rear elevation of a vent according to a seventh embodiment.
Figure 14:
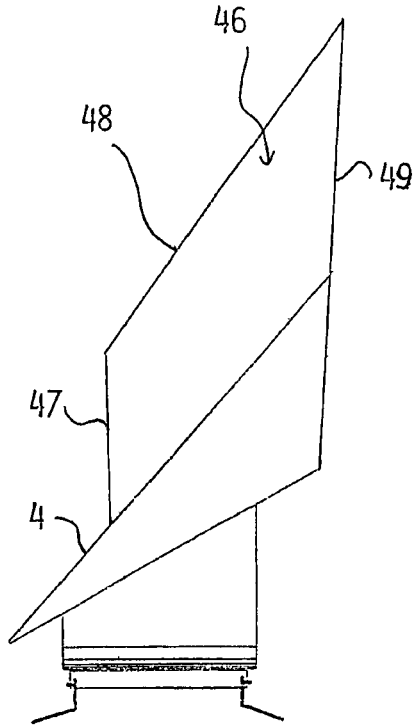
FIG. 14 is side elevation of the vent according to the seventh embodiment.

The seventh embodiment in the form of a vent 45 shown in FIGS. 13 and 14 is similar to the first embodiment being vane 1. The vane 46 is inclined towards the leeward direction along its upper most edge 48 and its most leeward substantially vertical edge 49 substantially follows the line of the corresponding edge of the inclined cowl 4, whereas the most windward edge 47 of the vane 46 is substantially vertical and extends beyond the vertical center line of the throat 2 in the windward direction. It is considered that the vane 46 displays superior responsiveness to changes in wind direction compared to the vane 3, but comprises more material and is therefore more expensive to manufacture. In the ventilation industry, minor variations in price per unit are significant due to the high manufacturing volumes involved.

Figure 15:
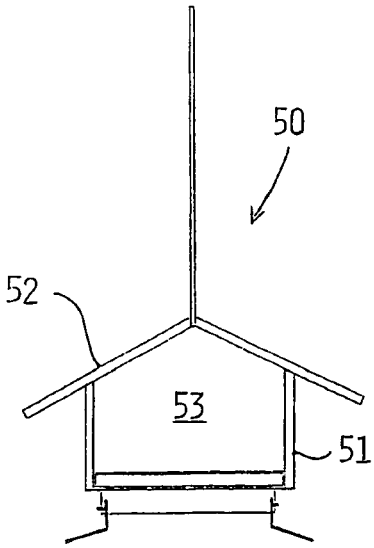
FIG. 15 is a front view of a vent according to an eighth embodiment.
Figure 16:
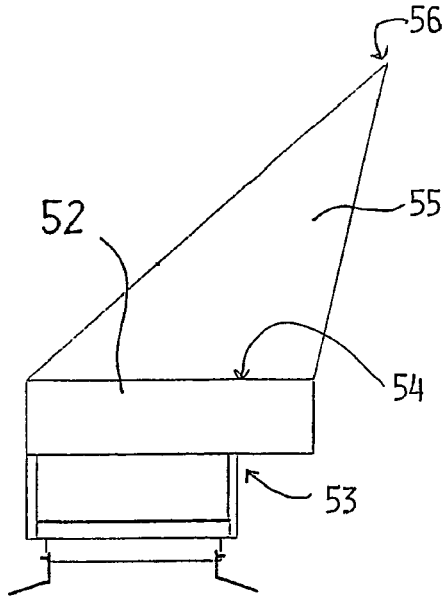
FIG. 16 is a side elevation of the vent according to the eighth embodiment.

In FIGS. 15 and 16, there is shown an eighth embodiment in the form of a vent 50, again made from planar sheets of perspex or glass wherein the throat 51 is rotatably mounted to a ring bearing similar to that described with reference to the first embodiment in FIGS. 1 and 2. The vent 50 is a particularly simple embodiment requiring minimal materials and involving the use of a small number of simple planar sheets of, for example, perspex. The throat 51 includes a pitched roof 52 which extends beyond the line of a mouth 53. Along the entire ridge line of the roof 52 the base edge 54 of a triangular vane 55 extends. Both upwardly extending and converging edges of the vane 55 are inclined towards and terminate at an apex 56. This configuration of the vane 55 effectively aligns itself to the direction of the wind, providing significant leverage for rotation of the throat most significantly in the region close to its apex 56.

Figure 17:
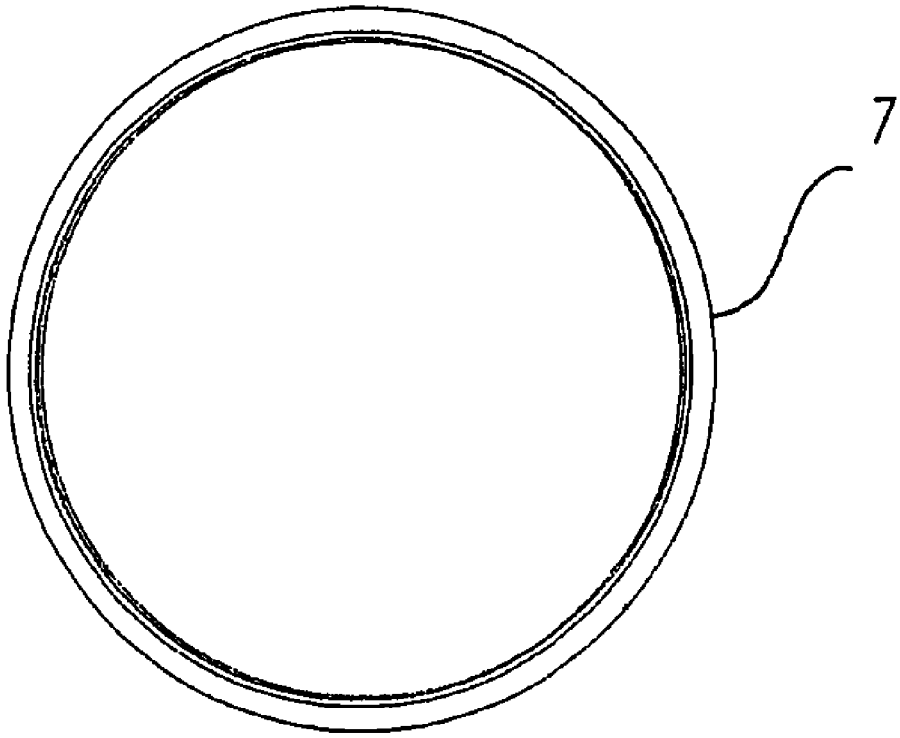
FIG. 17 is a plan view of a ring bearing.
Figure 18:
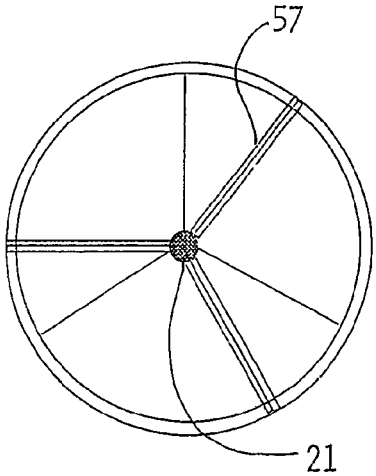
FIG. 18 is a plan view of a rotating spider with bearing around a fixed shaft.

A ring bearing 7 is shown in FIG. 17. The ring bearing 7 may be made using bearing surfaces made of a metal or non-metallic substrate optionally coated with teflon. Alternatively, the ring bearing may include or use a thrust bearing. In FIG. 18 there is shown a fixed shaft arrangement including a rotating bearing 21 mounted to a shaft whereby the inner race of the bearing 21 is fixed to the shaft and the outer race of the bearing is fixed directly or indirectly to radial arms 57 which rotatably support the throat 2, 16, 51.

Another arrangement according to one embodiment of the invention involves the addition of an infra red heat absorbing collar or panel (not shown) mounted around the vent or inside the throat of the vent external to the roof surface. The collar or panel is located outside the structure such as the roof attic space to limit radiant heat flow into the structure and allow for dissipation of heat to the outside environment.

The purpose of this embodiment is to promote and supplement the natural ventilation flow rate in say, nil wind conditions, by creating a temperature/pressure differential between the cooler air in the cavity such as a internal room space and the air heated at the exhaust point of the vent by the heat absorbing collar or panel. This has the effect of creating draft exhaust via stack/buoyancy flow.

Although not shown in FIGS. 1 to 16, it will be appreciated that the neck 6 may be coaxially fitted to a hollow shaft extending through a roof cavity and terminating at a ceiling having a suitable vented cover/diffuser. To permit venting of the roof cavity, the hollow shaft may include vents in its walls to permit exhaustion of air, not only from the cavity in the form of the internal space of a building below the ceiling, but also from the roof cavity. To optimise the transmission of natural light via the transparent or translucent vent 1, 15, 45, 35, 50 advantageously the inner surface of the hollow shaft is made from a reflective material.

Figure 19:
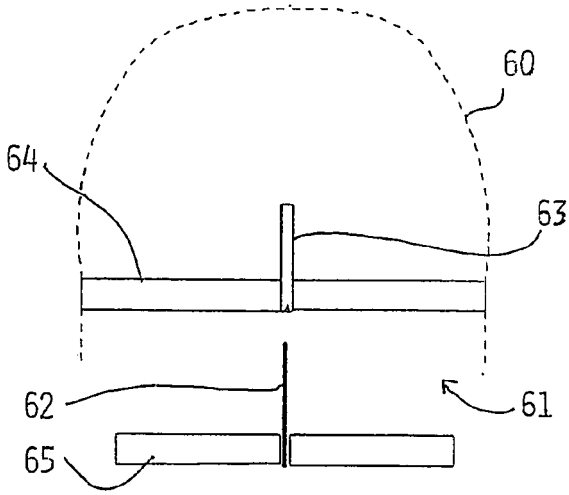
FIG. 19 is a schematic cross-section exploded front view of a hood for a vent mounted on a ring bearing according to a ninth embodiment.

Referring to FIG. 19, there is shown an exploded view of an alternative mounting means 4 for mounting a throat in the form of a hood 60, the mounting means including a bayonet connection 61. The bayonet connection 61 includes a fixed bayonet stub 62 adapted to be received in a cylindrical recess 63. The hood 60 is mounted to the cylindrical recess 63 by a spider 64. The stub 62 is fixedly mounted to a base 65. In plan view, the mounting arrangement 61 is similar to that shown in FIG. 18.

Figure 20:
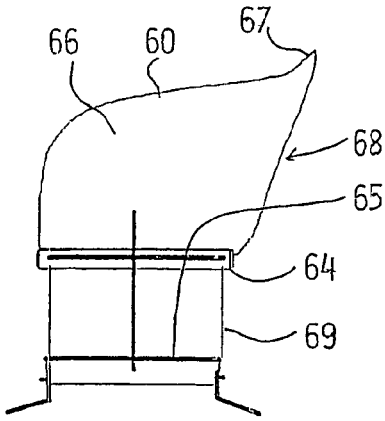
FIG. 20 is a schematic cross-sectional side view of a vent according to the ninth embodiment.

In FIG. 20, the side profile of the hood 60 is clearly shown. The hood 60 includes a curved shell 66 extending to a cowl 67 at its apex on the leeward side of the hood 60. The hood 60 includes a large mouth 68 defined by the apex 67 and the wall edges of the shroud depending towardly at an inclined angle to meet the ring of the spider 64 at spaced locations thereon. The arrangement includes a hollow cylindrical shaft 69 spacing the spider 64 from the base 65. The hollow shaft 69 may be used to elevate the hood 60 well above the roofline or to provide the communication of the hood 60 to the cavity through a roof or attic space.

Figure 21:
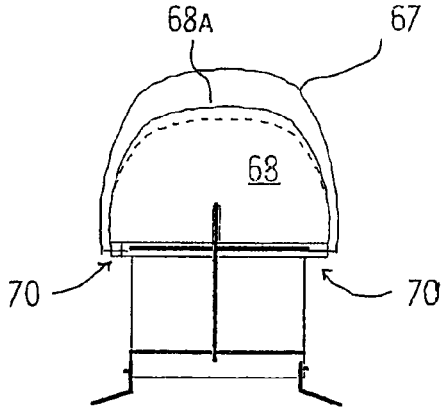
FIG. 21 is a schematic cross-sectional end view of the vent according to the ninth embodiment.

FIG. 21 shows the mouth 68 as defined by a flange 68A extending downwardly from the apex 67 and edges of the shell 66. The folded flange 68 provides a channel for water to be directed towards the spider 64 and dispensed at outlets 70 (see FIGS. 25 and 26). The channel provides means to reduce the ingress of rainwater and the like into the mouth 68.

Figure 22:
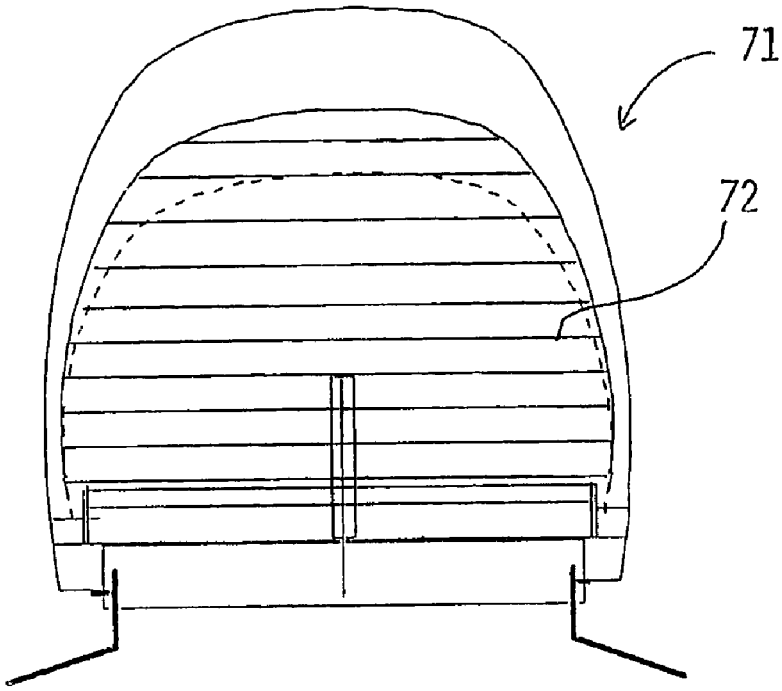
FIG. 22 is a schematic cross-sectional end view of a vent according to a tenth embodiment.
Figure 23:
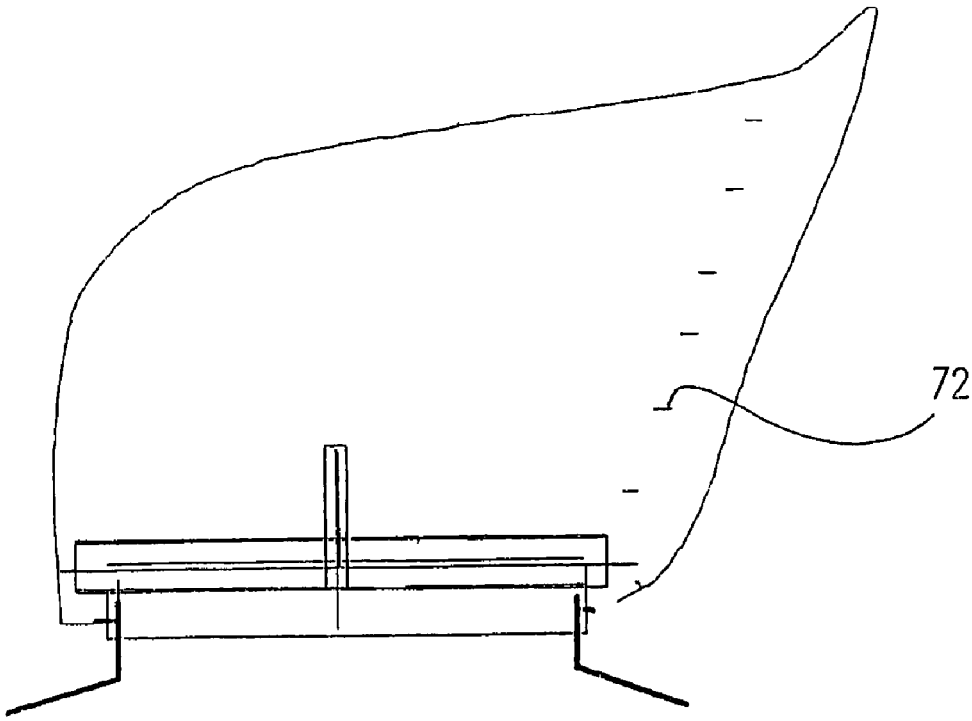
FIG. 23 is a schematic cross-sectional side view of the tenth embodiment.

In a tenth embodiment 71 shown in FIG. 22, the vent 71 includes screening means in the form of a plurality of parallel and horizontally aligned slats 72 adapted to screen out nuisances such as birds, possums and squirrels and vermin such as mice and rats. The slats 72 may optionally be pivotable about parallel axes and may be operable manually or by a servo-motor which may be, for example, remotely controlled whereby to provide a sealing means and a means for gradually effectively increasing the mouth opening.

Alternatively, the screening means may be in the form of parallel tensioned wire. In yet another alternative embodiment, the screening means may include flywire or mesh. The flywire or mesh may be adapted to prevent entry by a range of nuisances and pests such as birds, possums, squirrels, bees, wasps, cockroaches and ants. The flywire or mesh may be security grade or may be lighter gauge plastic or metal mesh primarily adapted to prevent the entry of insects.

Figure 24:
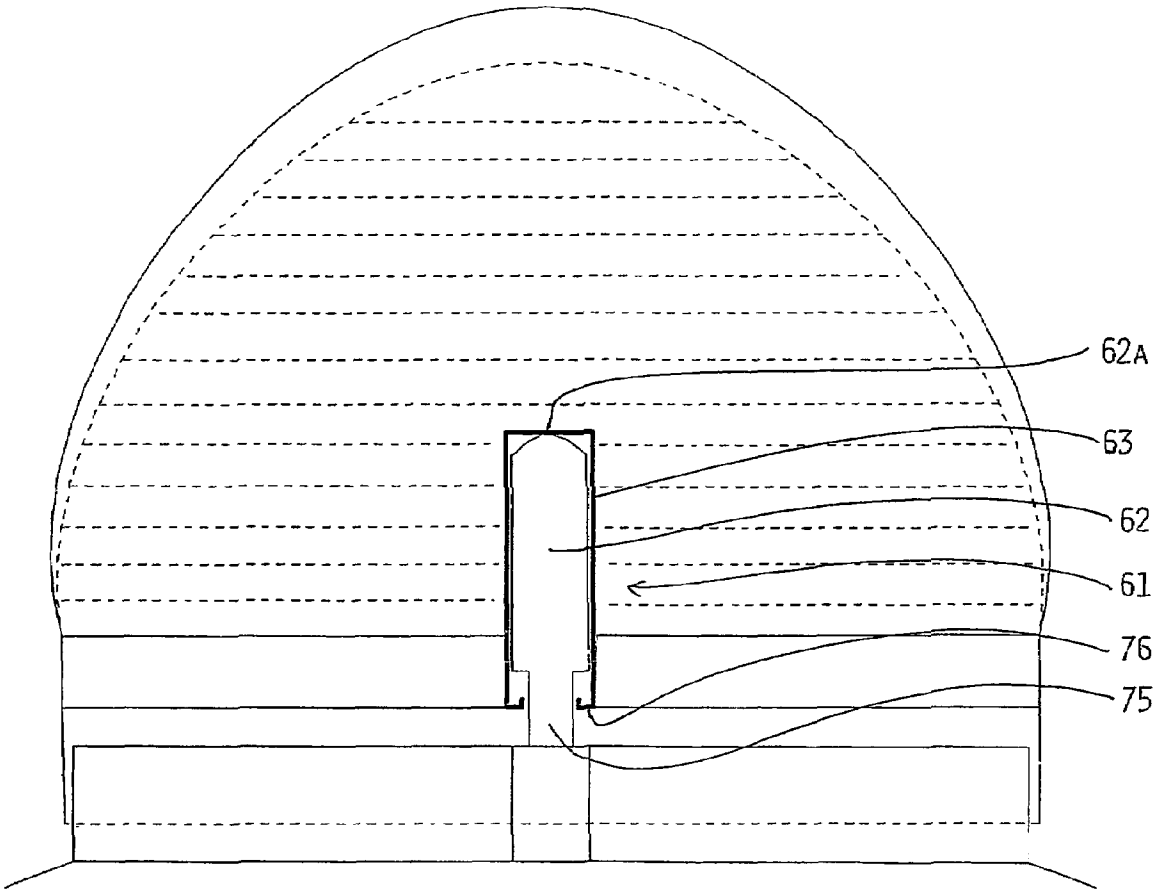
FIG. 24 is a detailed schematic cross-sectional end view of the tenth embodiment.

FIG. 24 more clearly shows the detail of a bayonet stub mounting arrangement 61 including the stub 62 and cylindrical recess 63. The extendible surfaces of the stub 62 and the internal surfaces of the cylindrical recess 63 may be Teflon™ (polytetrafluorethylene) coated to reduce friction or may comprise alternative lubrication or bearing means such as rotation bearings to reduce friction. The stub 62 terminates in a stub apex 62A again to minimise friction between the bearing surfaces of the stub apex 62A and the internal top surface of the cylindrical recess 63. The stub base 75 is of a smaller diameter than the main upper body of the stub 62. The base of the cylindrical recess 63 includes a deflectable annular flange 76 adapted to permit the entry of the stub 62 into the cylindrical recess 63 and to resist the withdrawal of the stub 62 from the recess 63. The flange 76 may be made from resilient material such as rubber or plastic. Preferably the flange 76 is made from a plastic material having a low friction surface to provide a low-friction bearing surface for the recess flange 76 on the stub base 75. Clearly this clip-on arrangement of the bayonet mounting arrangement 61 provides great convenience in the installation of the vent.

Figure 25:
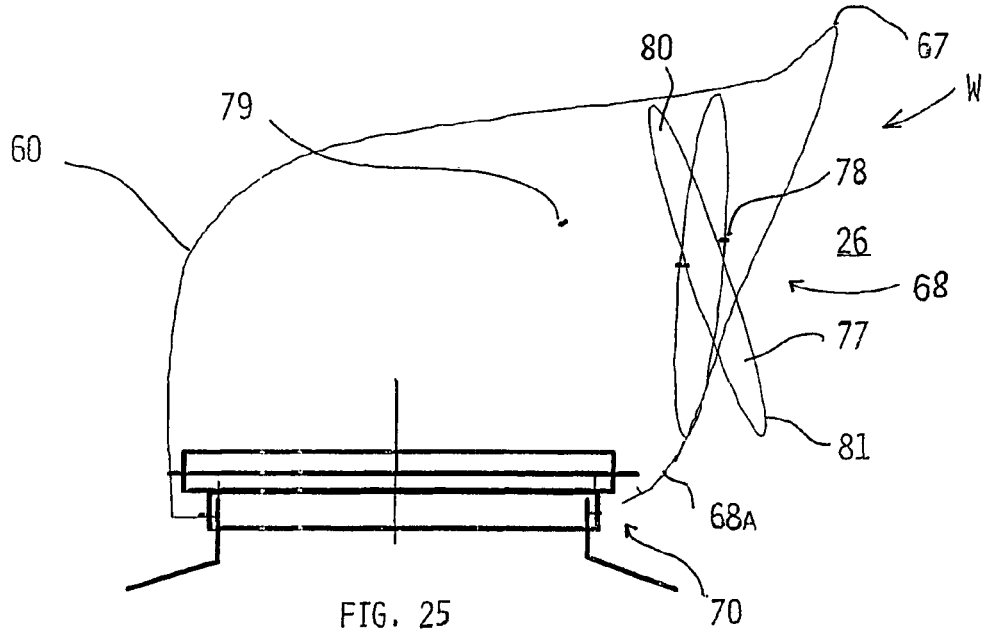
FIGS. 25 and 26 are schematic cross-sectional side views of a vent according to an eleventh embodiment showing a pivoting flap in operation.
Figure 26:
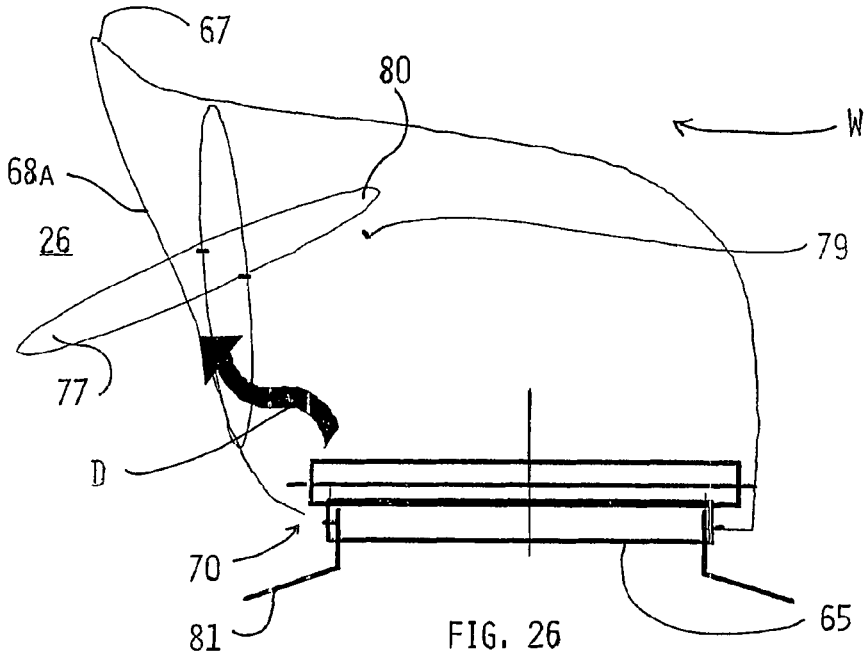

Referring finally to FIGS. 25 and 26, there is shown an alternative screening means in the form of a deflectable pivotable flap 77 mounted to pivoting points 78 on the respective internal surfaces of the hood 60. The flap 77 is adapted to pivot through an arc limited by a stop means 79 which may comprise one or more stubs formed in the moulded hood 60 or a lateral rod extending through the internal space of the hood 60. The stop means 79 is adapted to restrict the rotation of the flap 77, preferably the top portion 80. It is intended that the flap 77 generally will not rotate in a clockwise direction (as viewed in FIG. 25) beyond the vertical either because it is its natural resting position or because the base of the hood 60 provides a stop means beyond which the flap cannot pivot.

The flap 77, in combination with the cowl 67, is adapted to reduce the incidence of down drafts entering the vent from the immediate external environment. Accordingly, when a positive pressure exists immediately outside the mouth 68 in area 26, the flap 77 is urged to its vertical closed position whereby its lower portion 81 moves into abutting relationship with lower portions of the hood 60. The wind direction W interacts with the combined cowl 67 and hood 60 shape and configuration surrounding the mouth 68 and encounters high resistance when the hood is oriented in the direction whereby the cowl faces windward. The hood 60 is therefore urged to rotate such that the cowl 67 turns away from the wind and ends up facing the leeward direction. In this orientation, the cowl 67 and overall shape and configuration of the hood 60 causes least wind resistance and creates a negative pressure in the area 26. This causes a pressure differential between the cavity and the area 26 resulting in a draft D. The draft D urges the flap 77 to open by pivoting about pivot points 78 and, in its greatest open extent, the top portion 80 of the flap 77 rests on the stop means 79.

The drainage outlets 70 may more clearly be seen in FIGS. 25 and 26 which indicate that the channel of the flange 68*a* directs water down onto the mounting panels 81 of the base 65.

Throughout the specification the word "comprise" and its derivatives are intended to have an inclusive rather than exclusive meaning unless the context requires otherwise.

It will be appreciated by those skilled in the art that many modifications and variations may be made to the embodiments described herein without departing from the spirit or scope of the invention.

The invention claimed is:

1. A wind directional exhaust vent and skylight combination comprising:

a rotatable hood having a mounting means for rotatably securing the rotatable hood to a stationary building structure, the rotatable hood, having a throat terminating in a mouth, in communication with a cavity in the structure to be exhausted;

a wind directional means on or forming part of the hood effective to rotate the hood such that in response to wind the mouth tends to face the leeward wind direction to reduce rain penetration through the mouth into the throat and increase exhaust suction; and a vertically extending, stationary drag inducer mounted on or forming part of the hood immediately above the mouth;

wherein the rotatable hood includes at least one wall made from light transmitting material permitting the passage of ambient light and sunlight therethrough and into the cavity; and wherein a wind induced flow of air over the drag inducer creates a pocket of air having negative pressure immediately adjacent the mouth for further inducing an exhaust flow of air outward from the cavity.

2. A combination according to claim 1 wherein the wind directional means is a physical feature inherent in the overall external shape and configuration of the hood.

3. A combination according to claim 1, wherein the wind directional means is provided by the shape of the hood, and wherein a hood wall surrounding the mouth defines a wide surface area, and wherein a hood portion remote from the mouth presents a small surface area such that the hood wall surrounding the mouth encounters higher wind resistance than the hood portion remote from the mouth, and wherein the wind directional means presents a small surface area causing the hood to rotate until it is oriented to encounter least wind resistant with the mouth facing a leeward direction.

4. A combination according to claim 1, further including a hollow shaft extending through a roof cavity and an internal surface of the shaft is reflective to transmit the light from the throat to the cavity with minimal light absorption.

5. A combination according to claim 4, wherein the hollow shaft includes vents for exhausting the roof cavity.

6. A combination according to claim 1, wherein the throat includes a fixed reflector facing the general direction from which sunlight predominantly comes.

7. A combination according to claim 1, wherein the drag inducer includes an upper surface which is inclined in a downward direction towards the windward direction and the hood portion, remote from the mouth, when the mouth is facing in a leeward direction.

8. A combination according to claim 1, wherein the hood is mounted using an annular bearing on which the hood rotates.

9. A combination according to claim 1, wherein the mounting means includes a spindle bearing.

10. A combination to claim 1, wherein the mounting means includes engagement means adapted to snap fit together.

11. A combination according to claim 10, wherein the engagement means includes a spindle bayonet and a cylindrical recess which snap fit together.

12. A combination according to claim 1, wherein the hood includes a screening means.

13. A combination according to claim 12, wherein the screening means includes a plurality of parallel horizontal slats.

14. A combination according to claim 12, wherein the screening means includes a movable flap.

15. A combination according to claim 14, wherein the movable flap is adapted to control the direction of the draft through the throat.

16. The combination according to claim 1, wherein the hood further comprises an infra red heat absorbing material.

17. A wind directional vented skylight combination comprising:

a throat having a mounting structure for rotatably securing the throat to a structure, the throat for communicating with a cavity to be exhausted from within the structure, and the throat having a mouth for communicating with the cavity through an interior of the throat;

a wind directional structure, mechanically associated with the throat, for rotating and positioning the mouth in an orientation leeward to a direction of the wind; and a drag inducer statically mounted on the throat, immediately above the mouth;

wherein at least a portion of the throat is made from light transmitting material permitting the passage of light therethrough; and wherein a wind induced flow of air over the drag inducer creates turbulence and a resulting pocket of air having negative pressure to form in front of the mouth for inducing an exhaust flow of air outward from the cavity.

18. The wind directional vented skylight according to claim 17, wherein the drag inducer statically mounted on the throat comprises a flange member extending laterally along either side of the wind directional means.

19. The wind directional vented skylight according to claim 17, wherein the wind directional structure comprises a light transmitting material.

20. The wind directional vented skylight according to claim 17, further comprising a flap pivotally mounted in the throat adjacent the mouth and having a stopping member to limit rotation of the flap between an open position and a closed position, wherein the flap is configured to rotate between an open position and a closed position, wherein the flap is configured to rotate to the closed position upon positive pressure existing at the mouth and to the open position upon negative pressure existing outside the mouth.

* * * * *